US008950489B2

(12) United States Patent
Ayers

(10) Patent No.: US 8,950,489 B2
(45) Date of Patent: Feb. 10, 2015

(54) ANNULAR DISPOSED STIRLING HEAT EXCHANGER

(75) Inventor: David Blaine Ayers, Sugar Land, TX (US)

(73) Assignee: Sondex Wireline Limited (GB)

( * ) Notice: Subject to any disclaimer, the term of this patent is extended or adjusted under 35 U.S.C. 154(b) by 512 days.

(21) Appl. No.: 13/301,289

(22) Filed: Nov. 21, 2011

(65) Prior Publication Data

US 2013/0126245 A1 May 23, 2013

(51) Int. Cl.
*E21B 36/00* (2006.01)
*F25B 9/14* (2006.01)

(52) U.S. Cl.
CPC ..... *F25B 9/14* (2013.01); *E21B 36/001* (2013.01); *E21B 36/00* (2013.01)
USPC ..... 166/302; 62/6; 60/516; 166/57

(58) Field of Classification Search
CPC ..... E21B 12/00; E21B 36/00; E21B 36/001; F25B 9/14; F25B 9/145
USPC ..... 175/315; 166/302, 57, 61; 165/45, 47; 62/6; 60/516
See application file for complete search history.

(56) References Cited

U.S. PATENT DOCUMENTS

| | | | | |
|---|---|---|---|---|
| 4,512,150 | A * | 4/1985 | Benson | 60/526 |
| 5,390,496 | A | 2/1995 | El Affaqui | |
| 6,336,408 | B1 * | 1/2002 | Parrott et al. | 102/312 |
| 6,612,117 | B2 * | 9/2003 | Kasmer | 62/6 |
| 6,684,637 | B2 * | 2/2004 | Beale | 60/526 |
| 7,913,498 | B2 * | 3/2011 | Rowatt | 62/115 |
| 8,131,468 | B2 * | 3/2012 | Kischkat et al. | 702/6 |
| 2004/0088973 | A1 * | 5/2004 | Tanaka | 60/520 |
| 2005/0072148 | A1 * | 4/2005 | Francois et al. | 60/516 |
| 2005/0097911 | A1 * | 5/2005 | Revellat et al. | 62/259.2 |
| 2008/0223579 | A1 * | 9/2008 | Goodwin | 166/302 |
| 2008/0307797 | A1 * | 12/2008 | Okamoto | 62/6 |
| 2009/0032259 | A1 * | 2/2009 | DiFoggio et al. | 166/302 |
| 2012/0125614 | A1 * | 5/2012 | Verma et al. | 166/302 |

* cited by examiner

*Primary Examiner* — Jennifer H Gay
*Assistant Examiner* — David Carroll
(74) *Attorney, Agent, or Firm* — GE Global Patent Operation; Joanna M. Dombrowski

(57) ABSTRACT

Apparatus and method for cooling internal components of a down-hole well drilling apparatus. Components of the well drilling apparatus are encased in an inner canister that is further encased in an outer canister creating a void between the inner canister and the outer canister. Further, a plurality of moveable barriers is disposed between the inner canister and the outer canister and contains a heat transfer fluid. A plurality of agitators add mechanical energy to the plurality of moveable barriers compressing and expanding, while repositioning, the heat transfer fluid and creating a heat pump based on a reverse Stirling cycle to remove heat from the cooler inner canister and transfer the heat to the hotter environment outside the outer canister.

8 Claims, 9 Drawing Sheets

ANNULAR DISPOSED STIRLING HEAT EXCHANGER

TECHNICAL FIELD

Embodiments of the subject matter disclosed herein generally relate to methods and devices and, more particularly, to mechanisms and techniques for cooling internal components of a downhole device using a heat exchanger based on a Stirling cycle.

BACKGROUND

Like other manufacturing disciplines, well drilling technology has been integrated with electronics for measurements, computing, communications, etc. As well drilling capabilities have allowed drilling of deeper wells, the temperature of the well fluid, otherwise known as "mud" has increased to the point where insulation and/or cooling of the downhole electronics is required to keep the electronics operational. Attempts have been made to insulate the electronics but even if a truly adiabatic insulator was available, the heat generated by the electronics themselves would lead to overheating if a cooling mechanism was not incorporated into the design of the electronics system.

Attempts have been made to provide a coolant to the electronic systems but the depth of state of the art wells has made this task difficult. Typical wells can be many thousands of feet deep and can include bends in the well that make plumbing one or more coolant lines to the drill head difficult. Further, existing methods of chaining multiple measurement and data collection downhole tools together in a single well further complicates an already difficult task of cooling individual tools and their associated electronic components. Further, attempts have been made to insulate the electronic components from the heat associated with the external environment but these attempts have resulted in a fixed operational time based on the amount of time required for the heat source to overcome the insulator, combined with heat generated by the electronics, and raise the temperature of the electronic components to a temperature at which they cannot operate.

Many prior art systems and mechanisms have evolved to transfer heat from a higher temperature region to a lower temperature region or to perform mechanical work based on the aforementioned energy transfer. One such device for performing mechanical work based on the described temperature difference is a Stirling engine. A Stirling engine is a device that converts thermal energy into mechanical energy by exploiting a difference in temperature between two regions.

The Stirling engine operates on the principle of the Stirling cycle which consists of four thermodynamic processes acting on a working fluid. The Stirling cycle consists of an isothermal expansion, an isovolumetric cooling, an isothermal compression and a isovolumetric heating. The output of the Stirling cycle is the ability to perform mechanical work based on movement of the piston in the Stirling engine. Noteworthy in the theory of the Stirling cycle is the reversible nature of the Stirling cycle. Accordingly it is possible to provide the mechanical energy to the Stirling engine and create a heat exchanger capable of transferring heat from a region of lower temperature to a region of higher temperature.

Accordingly, it would be desirable to provide devices and methods that avoid the afore-described problems and drawbacks of cooling downhole electronics.

SUMMARY

According to one exemplary embodiment, there is a heat pump apparatus comprising a plurality of flexible barriers separating a location to remove heat from a location to add heat and enclosing a volume through which said heat transfers. Next in the exemplary embodiment, a heat transfer fluid, contained in the volume, for transferring heat based on an input of mechanical energy. Continuing with the exemplary embodiment, a plurality of mechanical agitators for imparting the mechanical energy as compressive and expansive force on the volume an alternating the location of the heat transfer fluid from a position adjacent to the location to remove heat to a position adjacent to the location to add heat.

According to another exemplary embodiment, there is a down-hole drilling apparatus including an inner canister encasing drilling components, an outer canister encasing the inner canister and creating a void between the inner canister and the outer canister and a heat pump apparatus disposed in the void between the inner canister and the outer canister. The exemplary embodiment continues with the heat pump apparatus comprising a plurality of flexible barriers separating a location to remove heat from a location to add heat and enclosing a volume through which said heat transfers. Next in the exemplary embodiment, a heat transfer fluid, contained in the volume, for transferring heat based on an input of mechanical energy. Continuing with the exemplary embodiment, a plurality of mechanical agitators for imparting the mechanical energy as compressive and expansive force on the volume an alternating the location of the heat transfer fluid from a position adjacent to the location to remove heat to a position adjacent to the location to add heat.

According to another exemplary embodiment, there is a method for cooling down-hole drilling components. The method includes encasing the drilling components in a first canister. The exemplary embodiment continues with encasing the first canister in a second canister and providing a void area between the first canister and the second canister. Next, the exemplary embodiment continues with inserting a plurality of flexible barriers in the void area between the first canister and the second canister. Further, the exemplary embodiment continues with adding mechanical energy by alternately compressing and expanding a heat transfer fluid, contained in a plurality of pockets created by the plurality of barriers, with agitators, wherein said agitators are moving approximately ninety degrees out of synchronization with each other. Next in the exemplary embodiment, shifting the position of the plurality of pockets alternately from a cooler position during expansion to a hotter position during compression to transfer heat from the cooler position to the hotter position.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of turbo-machinery including but not limited to compressors and expanders.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1A:
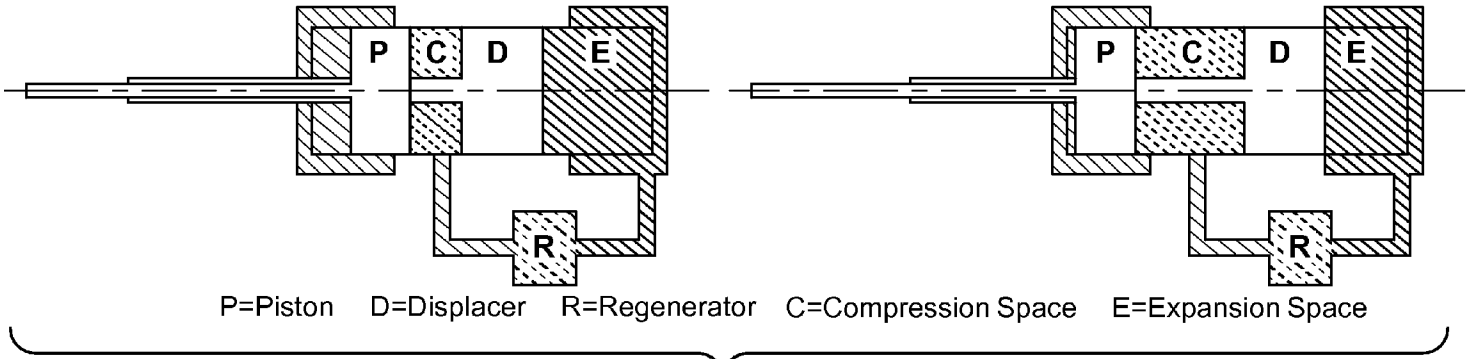
Fig. 1A (Prior Art)
FIGS. 1*a*-1*b* are prior art exemplary embodiments of a Beta Type Stirling Engine representing the four thermodynamic processes comprising the Stirling cycle.
Figure 1B:
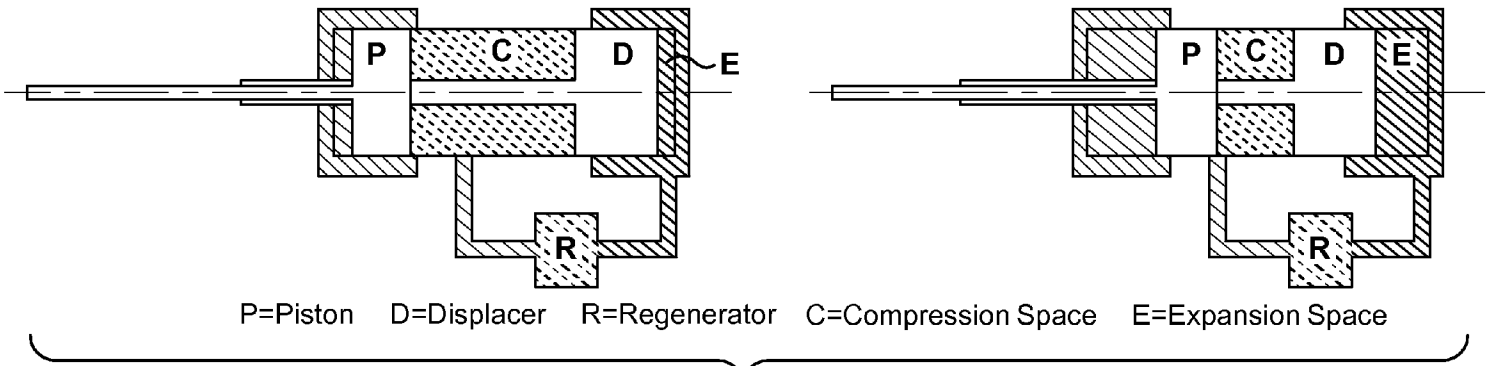
Fig. 1B (Prior Art)
Figure 2:
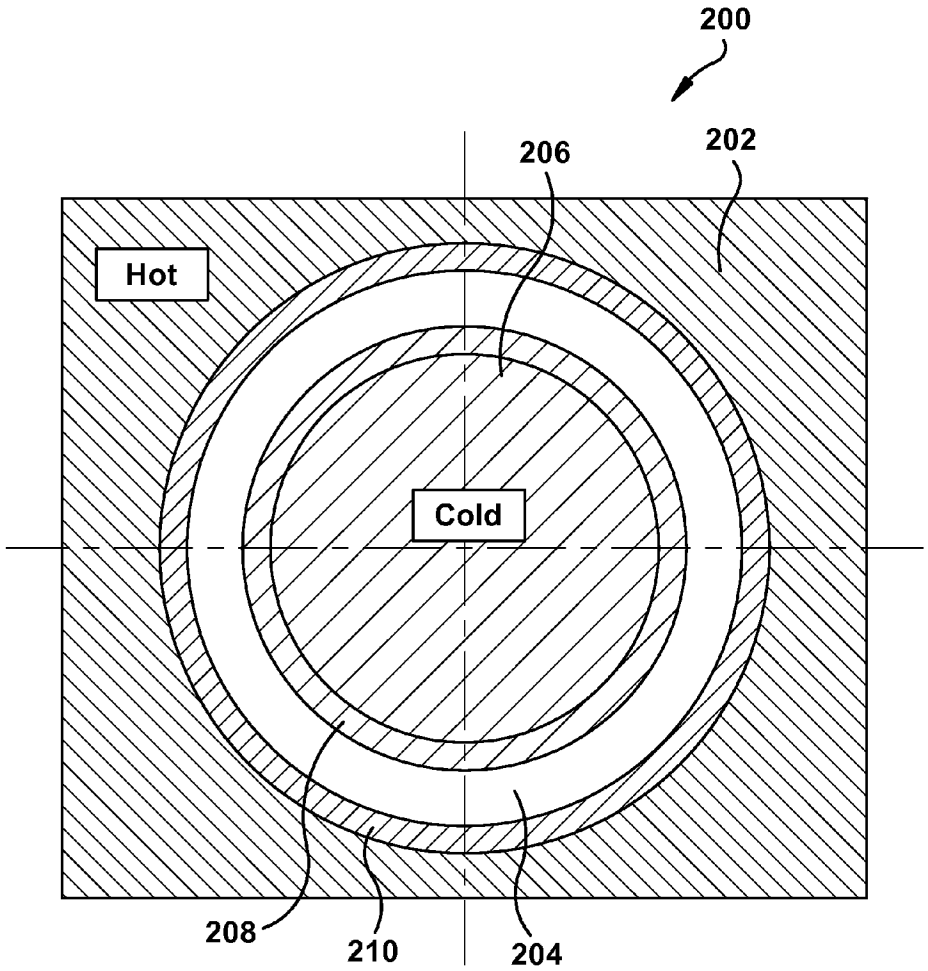
FIG. 2 is an exemplary embodiment depicting the higher temperature and lower temperature regions of a radial cross-section typically associated with downhole electronics of a drilling apparatus.

As shown in FIG. 2, an exemplary embodiment depicts a cross-section of a typical canister arrangement for a downhole drilling apparatus. In the exemplary embodiment the inner canister 208 encloses the cooler region. In one aspect of the exemplary embodiment, it is desired to maintain the internal region 206 at a temperature low enough to permit uninterrupted operation of the electronics associated with the drilling operations, including but not limited to drill control, data collection and communications to external locations. In another aspect of the exemplary embodiment an outer canister 210 encases the inner canister 208 and provides a void area 204 between the inner canister 208 outer wall and the outer canister 210 inner wall. It should be noted in the exemplary embodiment that a support structure (not shown) maintains the predefined void area between the inner canister 208 and the outer canister 210. Continuing with the exemplary embodiment, an external region 202 outside the outer canister 210 is at a temperature higher than the temperature of the internal region 206 inside the inner canister 208 and higher than the operational maximums of the electronics associated with the drilling operations. It should be noted in the exemplary embodiment that the external region 202 is a heat source with effectively unlimited capacity.

Figure 3:
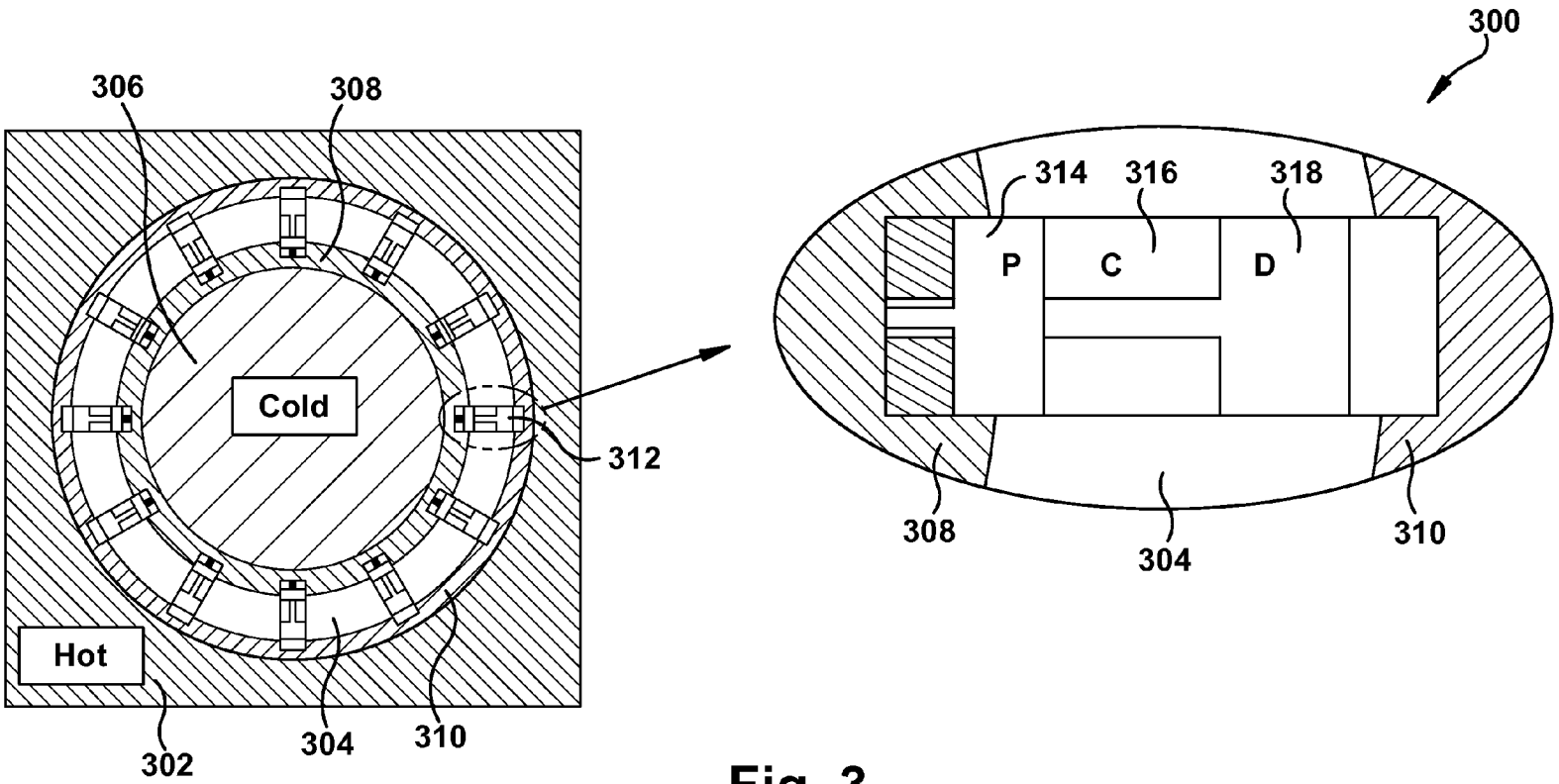
FIG. 3 is an exemplary embodiment depicting the higher temperature and lower temperature regions of a radial cross-section typically associated with downhole electronics of a drilling apparatus including a plurality of beta type Stirling engines connected to the two regions across the void between the two regions with an exploded view of a Stirling engine.

Looking now to FIG. 3, an exemplary embodiment depicts another cross-section 300 of a typical canister arrangement for a downhole drilling apparatus. The cross-section 300 includes an inner canister 308 enclosing a cooler region 306, with respect to a hotter region 302, and an outer canister 310 encasing the inner canister 308 and provides a void area 304 between the outer wall of the inner canister 308 and the inner wall of the outer canister 310. It should be noted that the hotter region 302 is effectively unlimited with regard to its heat capacity.

Continuing with the exemplary embodiment, a plurality of beta type Stirling engines are connected between the outer wall of the inner canister 308 and the inner wall of the outer canister 310. In one aspect of the exemplary embodiment, the Stirling engines 312 serve as a support structure for maintaining the void area 304 between the inner canister 308 and the outer canister 310. In another aspect of the exemplary embodiment, the Stirling engines 312 are constructed of an insulating material to prevent the transfer of heat from the hotter region 302 to the cooler region 306. Further in the exemplary embodiment, mechanical energy is provided to the Stirling engines 312 to reverse the Stirling cycle forcing the Stirling engines 312 to operate as heat pumps for cooling the region inside the inner canister 308.

As depicted in the exploded view of the Stirling Engines 312, mechanical energy (not shown) is provided to a piston 314 to compress the working fluid in the compression zone 316, therefore heating the working fluid and transferring heat energy through the outer canister 310 to the hotter region 302 based on the position of the displacer 318 moving the working fluid to the end of the Stirling engine 312 adjacent to the hotter region 302 outside the outer canister 310. Next in the exemplary embodiment, as the piston 314 expands the volume, the working fluid cools and the displacer 318 forces the cooler working fluid to the end of the Stirling engine adjacent toward the cooler inner canister 308 therefore cooling the region inside the canister 306.

Further, it should be noted in the exemplary embodiment that additional parallel planes of Stirling engines can be configured based on operational parameters and conditions dictating the amount of required cooling. It should be noted in the exemplary embodiment that the number of Stirling engines in a single cross-sectional plane is not limited to the number depicted in cross-section 300 and can be a larger or smaller number based on circumstances associated with the particular heat transfer and/or structural requirements.

Figure 4:
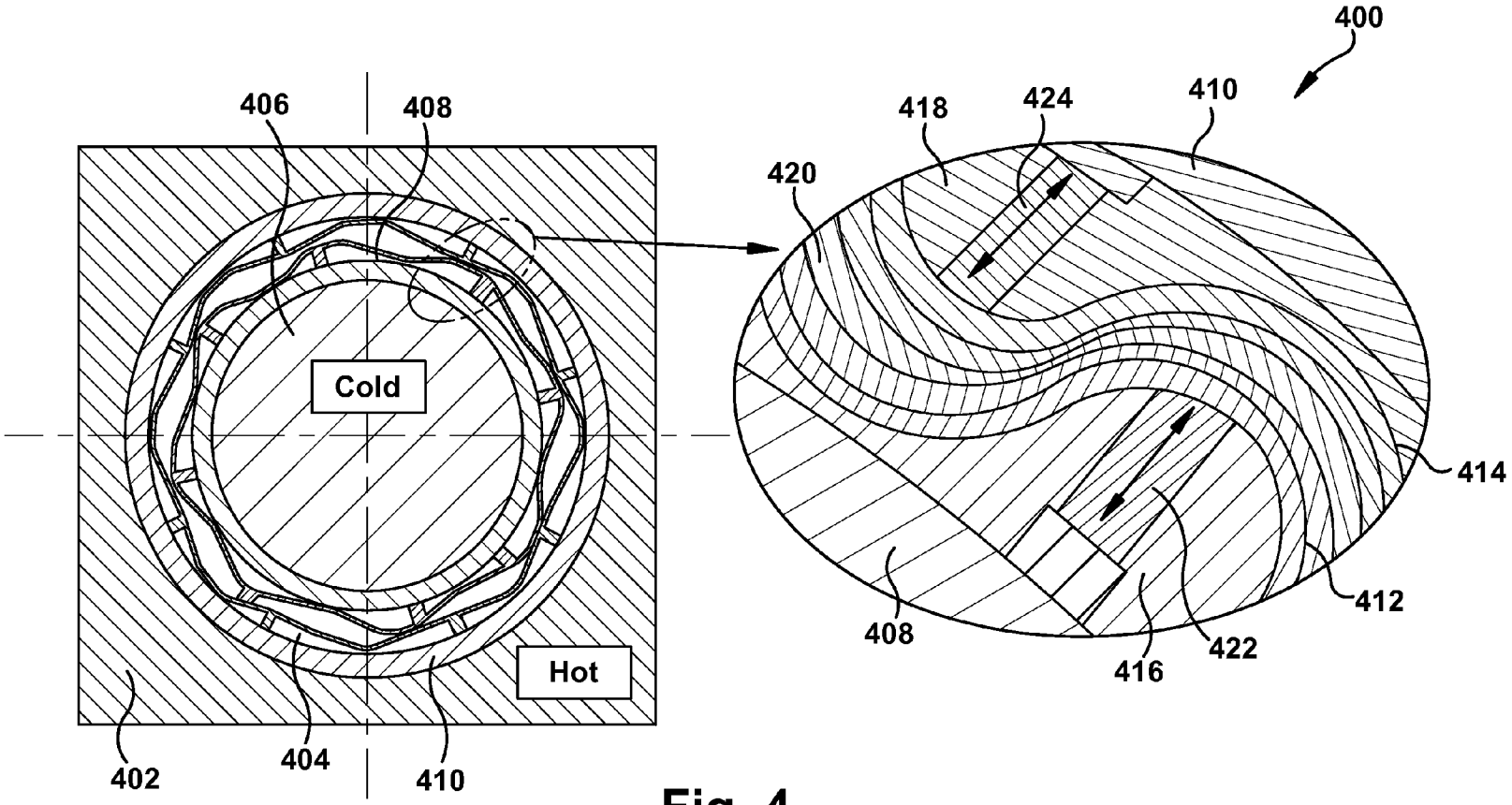
FIG. 4 is an exemplary embodiment depicting the higher temperature and lower temperature regions of a radial cross-section typically associated with downhole electronics of a drilling apparatus including a moveable dual-barrier Stirling cycle heat exchanger located in the void between the two regions with an exploded view of the dual-barrier interacting radially with a plurality of pistons.

Looking now to FIG. 4, an exemplary embodiment depicts another cross-section 400 of a typical canister arrangement for a downhole drilling apparatus. The cross-section 400 includes an inner canister 408 enclosing a cooler region 406, with respect to a hotter region 402, and an outer canister 410 encasing the inner canister 408 and providing a void area 404 between the outer wall of the inner canister 408 and the inner wall of the outer canister 410. It should be noted that the hotter region 402 is effectively unlimited with regard to its heat capacity.

Continuing with the exemplary embodiment, a flexible inner barrier 412 and a flexible outer barrier 414, located in the void space 404 between the inner canister 408 and the outer canister 410, separates an inner gas volume 416 from an outer gas volume 418 and encases a heat transfer fluid 420 between the inner barrier 412 and the outer barrier 414. Next in the exemplary embodiment, a plurality of inner pistons 422 is attached to the outer surface of the inner canister 408 and exerts a radial force outward on the inner barrier 412. Similarly in the exemplary embodiment, a plurality of outer pistons 424 is attached to the inner surface of the outer canister 410 and exerts a radial force inward on the outer barrier 414.

Further in the exemplary embodiment, it should be noted that the inner canister pistons 422 and the outer canister pistons 424 are mounted such that they are diagonally across from each other as illustrated in the exploded view of FIG. 4 and oscillate approximately ninety degrees out of phase of each other. It should also be noted in the exemplary embodiment that the mechanical energy provided to the system to oscillate the inner barrier 412 and the outer barrier 414 can be provided, as illustrated in FIG. 4, not only by pistons but also by electric motors, solenoids, piezoelectric ceramics, acoustic waves, etc.

The exemplary embodiment depicted in FIG. 4 illustrates the use of a series of radial force applications, by the exemplary pistons 422/424, to oscillate the two barriers in such a manner as to input mechanical energy into the barriers and create a heat pump, based on a reverse Stirling cycle, for transferring heat from the cooler region 406 to the hotter region 402 and preserving a desired temperature of operation within the cooler region 406 inside the inner canister 408. For example, an inner canister piston 422 acts as a compression piston in the hot cycle, compressing and heating the heat transfer fluid 420 while displacing the compressed and heated fluid toward the higher temperature outer canister 410 and allowing heat transfer from the heat transfer fluid to the hotter region 402. Continuing with the example of the exemplary embodiment, approximately ninety degrees out of phase with the inner canister piston 422, the outer canister piston 424 acts a compression piston in the cold cycle, moving an adjacent section of the heat transfer fluid 420 toward the lower temperature inner canister 408 while the inner canister piston 422 retracts to increase the volume occupied by the heat transfer fluid 420 and cools the heat transfer fluid 420 with the channel between the inner barrier 412 and the outer barrier 414 acting as a regenerator and allowing heat transfer from the cooler region 406 to the heat transfer fluid 420.

Figure 5:
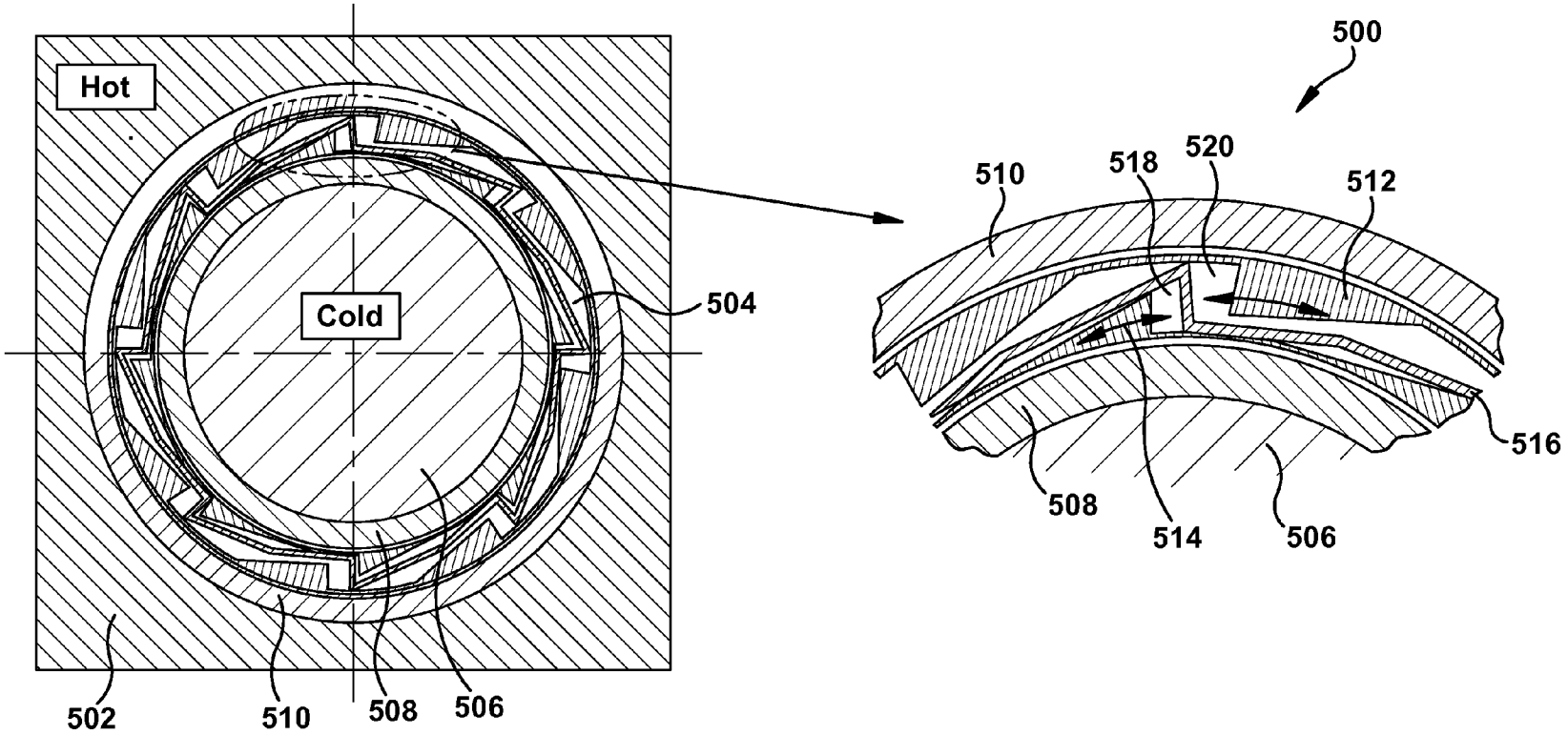
FIG. 5 is an exemplary embodiment depicting the higher temperature and lower temperature regions of a radial cross-section typically associated with downhole electronics of a drilling apparatus including a barrier ring Stirling cycle heat exchanger located in the void between the two regions with an exploded view of the barrier ring interacting tangentially with a working fluid.

Looking now to FIG. 5, an exemplary embodiment depicts another cross-section 500 of a typical canister arrangement for a downhole drilling apparatus. The cross-section 500 includes an inner canister 508 enclosing a cooler region 506, with respect to a hotter region 502, and an outer canister 510 encasing the inner canister 508 and providing a void area 504 between the outer wall of the inner canister 508 and the inner wall of the outer canister 510. It should be noted that the hotter region 502 is effectively unlimited with regard to its heat capacity.

Continuing with the exemplary embodiment, a plurality of saw tooth outer agitators 512 are paired with a plurality of saw tooth inner agitators 514 functioning as the hot cycle compression piston and the cold cycle compression piston as described in the example for FIG. 4. In the exemplary embodiment, the saw tooth agitators 512, 514 oscillate in an angular direction around the shared axis of the inner canister 508 and the outer canister 510. Further in the exemplary embodiment, the barrier ring 516 acts as the regenerator described in the example for FIG. 4. In a similar manner as described for the example of FIG. 4, adding mechanical energy to the agitators 512, 514 operates a reverse Stirling cycle heat pump and transfers heat from the cooler region 506 to the hotter region 502 based on compression and expansion of a heat transfer fluid located in an inner volume 518 and an outer volume 520 between inner canister 508 and outer canister 510.

Figure 6:
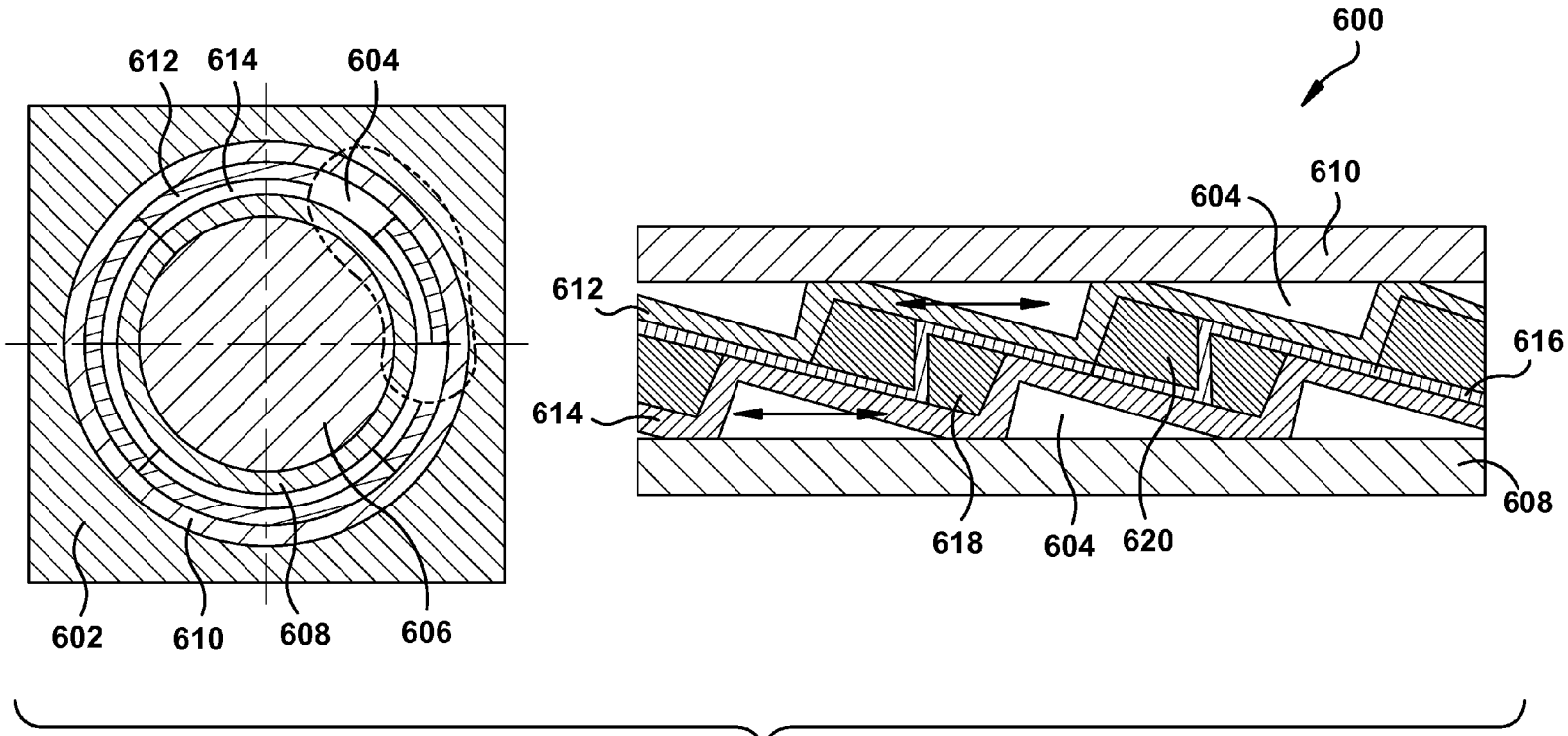
FIG. 6 is an exemplary embodiment depicting the higher temperature and lower temperature regions of a radial cross-section typically associated with downhole electronics of a drilling apparatus including a barrier ring Stirling cycle heat exchanger located in the void between the two regions with an exploded view of the barrier ring interacting axially with a working fluid.

Looking now to FIG. 6, an exemplary embodiment depicts another cross-section 600 of a typical canister arrangement for a downhole drilling apparatus. The cross-section 600 includes an inner canister 608 enclosing a cooler region 606, with respect to a hotter region 602, and an outer canister 610 encasing the inner canister 608 and providing a void area 604 between the outer wall of the inner canister 608 and the inner wall of the outer canister 610. It should be noted that the hotter region 602 is effectively unlimited with regard to its heat capacity.

Continuing with the exemplary embodiment, a saw tooth outer barrier 612 is paired with a saw tooth inner barrier 614 functioning as the hot cycle compression piston and the cold cycle compression piston respectively, as described in the example for FIG. 4. Further in the exemplary embodiment, the barrier ring 616 acts as the regenerator described in the example for FIG. 4. In a similar manner as described for the example of FIG. 4, adding mechanical energy to the saw tooth barriers 612, 614 operates a reverse Stirling cycle heat pump and transfers heat from the cooler region 606 to the hotter region 602 based on compression and expansion of a heat transfer fluid located in an inner volume 618 and an outer volume 620 between inner canister 608 and outer canister 610. It should be noted in the exemplary embodiment that the barriers 612, 614, 616 are oriented in an axial direction with regard to the common axis shared by the inner and outer canisters 608, 610 and the oscillation of the barriers 612, 614 is in the axial direction.

Figure 7:
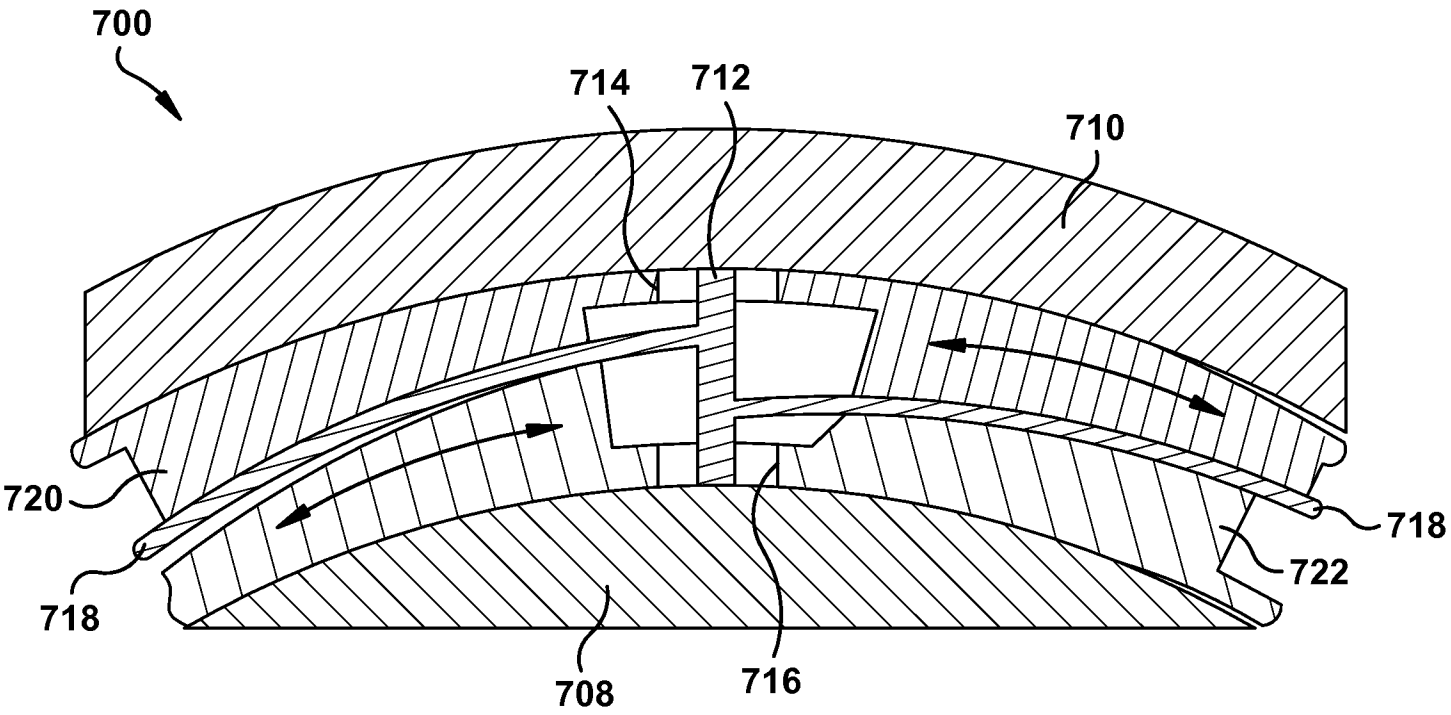
FIG. 7 is an exemplary embodiment depicting the higher temperature and lower temperature regions of a radial cross-section segment typically associated with downhole electronics of a drilling apparatus including a barrier ring Stirling cycle heat exchanger located in the void between the two regions with a support stud maintaining the annular gap between the inner and outer canister.

Looking now to FIG. 7, an exemplary embodiment depicts the saw tooth agitators of FIG. 5 including a support mechanism for maintaining the angular void between the inner canister 708 and the outer canister 710. Continuing with the exemplary embodiment, a support stud 712 is connected to the inner canister 708 and the outer canister 710. In the exemplary embodiment, the stud is a component of the barrier 718 between the outer agitators 720 and the inner agitators 722. Further in the exemplary embodiment, slots 714, 716 are cut in the agitator mechanism to allow the stud 712 to be attached to the inner canister 708 and the outer canister 710. Continuing with the exemplary embodiment, the studs 712 maintain mechanical integrity and dimensional consistency between the inner canister 708 and the outer canister 710 and protect the heat pump components from crushing associated dimensional change of the void area between the inner canister 708 and the outer canister 710. It should be noted in the exemplary embodiment that other support mechanisms such as, but not limited to, ball bearings, rollers or axial end studs can be used as a support mechanism for maintaining the angular void between the inner canister 708 and the outer canister 710.

Figure 8:
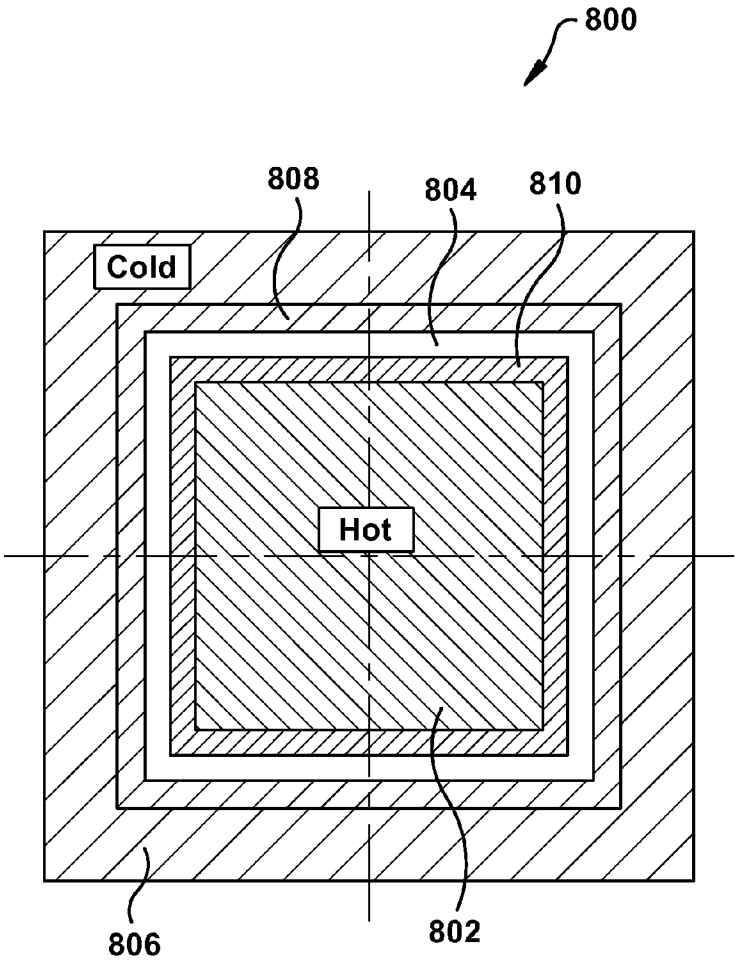
FIG. 8 is an exemplary embodiment depicting the higher temperature and lower temperature regions of a non-circular cross-section capable of supporting a barrier Stirling cycle heat exchanger located in the void between the two regions.

Looking now to FIG. 8, the exemplary embodiment illustrates that the hotter region 802 can be constrained by non-circular inner barrier 810 with a non-circular void between the inner barrier 810 and an outer barrier 808. In another aspect of the exemplary embodiment, the cooler outer region 806, as described for the hotter region in the previous examples, can have an infinite capacity to absorb heat. It should be noted that other shapes of barriers and voids between barriers are possible and should not be limited by these examples. In another aspect of the exemplary embodiment, movement of barriers acting as a reverse Stirling cycle power pistons can be in radial, angular or axial directions as previously described for the previous exemplary embodiments.

Figure 9:
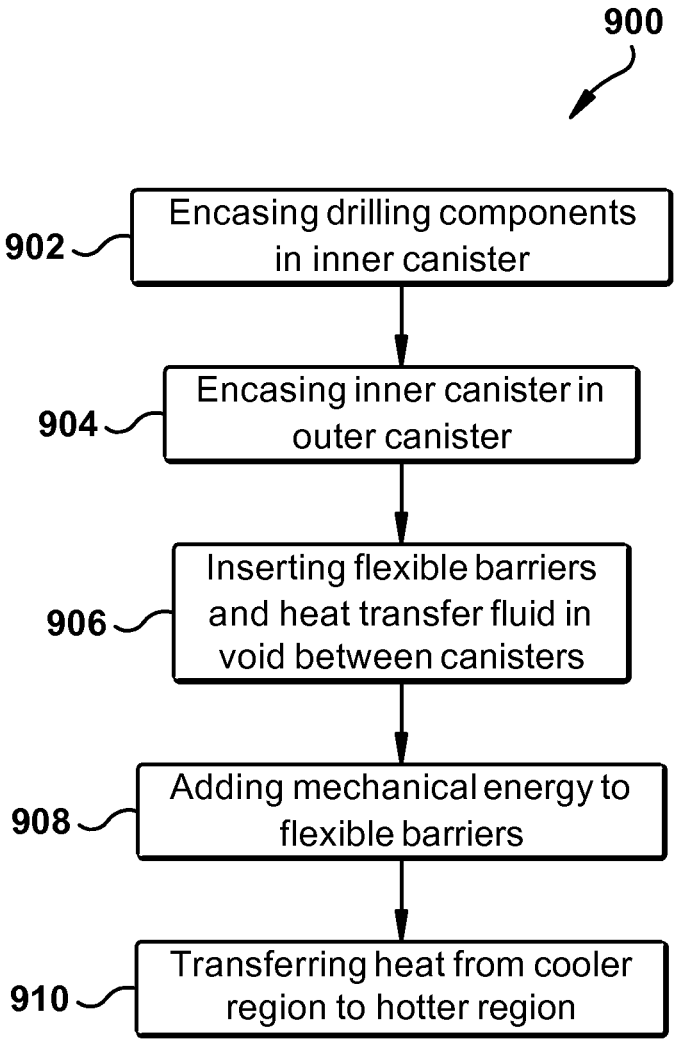
FIG. 9 is a flow chart illustrating steps for operating a barrier type Stirling heat exchanger according to an exemplary embodiment.

An exemplary method embodiment for cooling components of a down-hole well drilling apparatus is now discussed with reference to FIG. 9. FIG. 9 shows exemplary method embodiment steps for using a cooling system based on a reverse Stirling cycle to cool down-hole drilling components by transferring heat from an area housing the down-hole drilling components and transferring the heat to the drilling mud surrounding the outer casing of the drilling system. The exemplary method embodiment includes a step 902 of encasing drilling components in an inner canister. In one aspect of the exemplary method embodiment, the inner canister is typically cylindrical in shape and is typically the cooler region of the heat transfer path i.e. heat is removed from the volume inside the inner canister. It should be noted in the exemplary embodiment that the drilling components can be, but are not limited to, electronic components for control, data acquisition and communications and can generate heat based on component power consumption.

Next at step 904, the exemplary method embodiment continues by encasing the inner casing with an outer casing. The outer casing is typically has the same shape as the inner casing and creates a void between the inner casing and the outer casing. It should be noted that the inner casing and the outer casing share the same rotational axis i.e. the separation distance between the outer wall of the inner casing and the inner wall of the outer casing is maintained. It should further be noted that the region outside the outer casing is typically the hotter region of the heat transfer path i.e. the heat removed from the cooler region inside the inner canister is transferred to the hotter region outside the outer casing.

Continuing with step 906, the exemplary method embodiment inserts a plurality of flexible barriers in the void between the inner canister and the outer canister. It should be noted that in one exemplary embodiment, the barriers can have a saw tooth shape and can be oriented in an angular or an axial direction. Further, it should be noted in the exemplary embodiment that one or more additional barriers can be sandwiched between the inner and outer barrier and the inner and outer barrier can oscillate while the sandwiched barrier(s) can remain fixed and/or rigid. In another aspect of the exemplary embodiment, studs for maintaining dimensional integrity between the inner canister and the outer canister can be integrated in the sandwiched barrier(s) and extended through slots in the inner and outer barrier for attachment to the inner canister and the outer canister.

Next at step 908, the exemplary embodiment adds mechanical energy to the flexible barriers. In the exemplary embodiment, the mechanical energy is provided by agitators moving in a radial, angular or axial direction. It should be noted that the movement can be an oscillation of the agitators with the agitators configured as opposing pairs oscillating approximately ninety degrees out of phase of each other. In another aspect of the exemplary embodiment, the phase difference between the opposing pairs of agitators can vary by a phase selected based on design, maximizing efficiency or maximizing the economic value. It should further be noted that a heat transfer fluid is also inserted in the volume between the inner flexible barrier and the outer flexible barrier. Continuing with the exemplary embodiment, the agitator movement imparts compressions and expansions on the heat transfer fluid resulting in localized hot and cold volumes sufficient to provide a heat transfer path between the cooler region inside the inner canister and hotter region outside the outer canister.

Continuing with step 910, the exemplary embodiment transfers heat from the cooler region inside the inner canister to the hotter area outside the outer canister. It should be noted in the exemplary embodiment that the localized volumes of hotter and colder heat transfer fluid created by the agitator oscillations are displaced to a hotter outer location and a colder inner location, respectively, by the agitator movement, allowing the transfer of heat in the desired direction.

The disclosed exemplary embodiments provide devices and a method for implementing Stirling cycle coolers and energy generators in a down-hole drilling operation. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements to those recited in the literal languages of the claims.

What is claimed is:

1. A heat pump apparatus, comprising:

a plurality of moveable barriers separating a location to remove heat from a location to add heat and enclosing a volume through which said heat transfers;

a heat transfer fluid contained in said volume for transferring heat based on an input of mechanical energy;

a plurality of agitators for imparting said mechanical energy as compressive and expansive force on said volume and alternating the location of said heat transfer fluid from a position adjacent to said location to remove heat to a position adjacent to said location to add heat.

2. The apparatus of claim 1, wherein said plurality of agitators are paired and move in opposing directions out of phase by a preselected amount based on a most efficient or most economical operation.

3. The apparatus of claim 2, wherein said paired agitators movement is approximately ninety degrees out of phase with each other.

4. The apparatus of claim 3, wherein said agitators move in a radial direction.

5. The apparatus of claim 1, wherein said moveable barriers are constructed of an elastomeric material.

6. A down-hole drilling apparatus comprising:

an inner canister encasing drilling components;

an outer canister encasing said inner canister and creating a void between an outer wall of said inner canister and an inner wall of said outer canister; and a heat pump apparatus disposed in said void, comprising:

a plurality of moveable barriers separating a location to remove heat from a location to add heat and enclosing a volume through which said heat transfers;

a heat transfer fluid contained in said volume for transferring heat based on an input of mechanical energy;

a plurality of agitators for imparting said mechanical energy as compressive and expansive force on said volume and alternating the location of said heat transfer fluid from a position adjacent to said location to remove heat to a position adjacent to said location to add heat.

7. The apparatus of claim 6, wherein said agitators are configured as radially oscillating agitators.

8. A method for cooling down-hole drilling components, said method comprising:

encasing said components in a first canister;

encasing said first canister in a second canister and providing a void area between said first canister and said second canister;

inserting a plurality of flexible barriers in said void area between said first canister and said second canister;

adding mechanical energy by alternately compressing and expanding a heat transfer fluid, contained in a plurality of pockets created by said plurality of barriers, with agitators, wherein said agitators are moving approximately ninety degrees out of synchronization with each other; and shifting the position of said plurality of pockets alternately from a cooler position during expansion to a hotter position during compression to transfer heat from said cooler position to said hotter position.

* * * * *